US010658103B2

(12) United States Patent
Seino et al.

(10) Patent No.: US 10,658,103 B2
(45) Date of Patent: May 19, 2020

(54) COIL COMPONENT

(71) Applicant: TAIYO YUDEN CO., LTD., Taito-ku, Tokyo (JP)

(72) Inventors: Hirotaro Seino, Takasaki (JP); Shinsuke Takeoka, Takasaki (JP); Hitoshi Matsuura, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/465,489

(22) Filed: Mar. 21, 2017

(65) Prior Publication Data

US 2017/0287621 A1 Oct. 5, 2017

(30) Foreign Application Priority Data

Mar. 31, 2016 (JP) ..... 2016-073079

(51) Int. Cl.
*H01F 27/28* (2006.01)
*H01F 27/29* (2006.01)
(Continued)

(52) U.S. Cl.
CPC ..... *H01F 27/292* (2013.01); *H01F 1/26* (2013.01); *H01F 1/28* (2013.01); *H01F 17/0013* (2013.01); *H01F 17/04* (2013.01)

(58) Field of Classification Search
CPC .. H01F 5/003; H01F 17/0006; H01F 17/0013; H01F 2017/002; H01F 27/245;
(Continued)

(56) References Cited

U.S. PATENT DOCUMENTS 6,275,132 B1 * 8/2001 Shikama ..... H01F 27/29 29/602.1
6,600,404 B1 * 7/2003 Kajino ..... H01F 5/003 257/531
(Continued)

FOREIGN PATENT DOCUMENTS

CN 103503088 A 1/2014
JP 2008294085 A * 12/2008
(Continued)

OTHER PUBLICATIONS

A Notification of Reason for Refusal issued by Korean Intellectual Property Office, dated Jun. 12, 2018, for Korean counterpart application No. 1020180064117.
(Continued)

*Primary Examiner* — Tszfung J Chan
(74) *Attorney, Agent, or Firm* — Law Office of Katsuhiro Arai

(57) ABSTRACT

A coil component has a magnetic body of rectangular solid shape, a coil with N turns (N is a positive number of 2 or greater) provided inside the magnetic body, an insulating intermediate part, and external electrodes. The coil has a first conductor layer, a second conductor layer, and an inter-layer connection part. The first conductor layer has a first multiple winding part which is wound around one axis with a first spacing. The second conductor layer has a second multiple winding part which is wound around the one axis with the first spacing and faces the first conductor layer. The insulating intermediate part is provided inside the magnetic body and forms, between the first conductor layer and second conductor layer, a second spacing corresponding to a thickness equal to or less than the product of the first spacing and (N−1).

8 Claims, 3 Drawing Sheets

(51) Int. Cl.

| | |
|---|---|
| ***H01F 17/04*** | (2006.01) |
| ***H01F 1/26*** | (2006.01) |
| ***H01F 1/28*** | (2006.01) |
| ***H01F 17/00*** | (2006.01) |

(58) Field of Classification Search
CPC ..... H01F 27/2804; H01F 2027/2809; H01F 2027/2814; H01F 27/2847; H01F 27/2866; H01F 27/292
USPC ..... 336/200, 232
See application file for complete search history.

(56) References Cited

U.S. PATENT DOCUMENTS

| | | | | |
|---|---|---|---|---|
| 2001/0033219 | A1* | 10/2001 | Iha | G03F 7/0047 336/90 |
| 2009/0278240 | A1* | 11/2009 | Kaneko | H01L 23/5227 257/659 |
| 2009/0283306 | A1* | 11/2009 | Nishino | C03C 8/02 174/257 |
| 2013/0127576 | A1* | 5/2013 | Hachiya | H01F 27/255 336/200 |
| 2013/0249664 | A1* | 9/2013 | Tonoyama | H01F 41/04 336/200 |
| 2014/0132383 | A1 | 5/2014 | Matsuura et al. | |
| 2015/0035634 | A1 | 2/2015 | Nakamura et al. | |
| 2015/0287515 | A1* | 10/2015 | Choi | H01F 17/0013 336/200 |

FOREIGN PATENT DOCUMENTS

| | | | | | |
|---|---|---|---|---|---|
| JP | 2008294085 | A | | 12/2008 | |
| JP | 2010205905 | A | | 9/2010 | |
| JP | 2013131578 | A | * | 7/2013 | H01F 5/003 |
| JP | 2015032625 | A | | 2/2015 | |
| JP | 2015170846 | | | 9/2015 | |
| KR | 1020130101849 | A | | 9/2013 | |
| KR | 1020130126737 | A | | 11/2013 | |
| KR | 1020150080798 | A | | 7/2015 | |

OTHER PUBLICATIONS

A First Office Action issued by the State Intellectual Property Office of China dated May 29, 2018 for Chinese counterpart application No. 201710208229.8.

Notification of Reason for Refusal issued by Korean Intellectual Property Office, dated Apr. 3, 2018, for Korean counterpart application No. 1020170033716.

A Notice of Final Rejection issued by Korean Intellectual Property Office, dated Sep. 27, 2018, for Korean counterpart application No. 1020170033716.

A Notification of Reasons for Refusal issued by the Japanese Patent Office, dated Dec. 11, 2018, for related Japanese application No. 2016-073079.

A Second Office Action issued by the State Intellectual Property Office of China dated Jan. 18, 2019 for Chinese counterpart application No. 201710208229.8. (6 pages).

A Decision of Refusal issued by the Japanese Patent Office, dated May 14, 2019, for related Japanese application No. 2016-073079. (3 pages).

A Third Office Action issued by the State Intellectual Property Office of China dated Jun. 18, 2019 for Chinese counterpart application No. 201710208229.8. (5 pages).

A Decision of Refusal issued by the State Intellectual Property Office of China dated Dec. 30, 2019 for Chinese counterpart application 201710208229.8 (4 pages).

* cited by examiner

COIL COMPONENT

BACKGROUND

Field of the Invention

The present invention relates to a coil component structured in such a way that its winding part constituted by conductive material is covered with magnetic material.

Description of the Related Art

With the multi-functionalization of mobile devices and electronization of automobiles, small coil components known as the "chip type" are widely in use. Among these coil components, laminated ones offer the benefit of supporting thickness reduction. A laminated coil component is constituted by a laminate that comprises multiple magnetic sheets on which coil patterns of specified shapes are formed, where the coil patterns on the respective layers are connected by vias to constitute a coil. For example, Patent Literature 1 describes a chip electronic component of two-layer structure, whose magnetic body has built-in spiral coil patterns.

BACKGROUND ART LITERATURES

[Patent Literature 1] Japanese Patent Laid-open No. 2015-170846

SUMMARY

In recent years, the trend for smaller, thinner electronic devices is pushing further size reduction and thickness reduction of the electronic components installed in these electronic devices. With the laminated coil component, however, reducing the insulating intermediate part present between the conductor layers may cause the dielectric strength to drop.

In light of the aforementioned situation, an object of the present invention is to provide a coil component that can be made thinner, while ensuring sufficient dielectric strength at the same time.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, the coil component pertaining to an embodiment of the present invention has a magnetic body of rectangular solid shape, a coil with N turns (N is a positive number of 2 or greater) provided inside the magnetic body, an insulating intermediate part, and external electrodes.

The coil has a first conductor layer, a second conductor layer, and an inter-layer connection part. The first conductor layer has a first multiple winding part which is wound around one axis with a first spacing. The second conductor layer has a second multiple winding part which is wound around the one axis with the first spacing and faces the first conductor layer. The inter-layer connection part inter-connects the inner periphery end of the first multiple winding part and the inner periphery end of the second multiple winding part.

The insulating intermediate part is provided inside the magnetic body and forms, between the first conductor layer and second conductor layer, a second spacing corresponding to a thickness equal to or less than the product of the first spacing and (N−1).

The external electrodes are provided on the magnetic body and connected, respectively, to the outer periphery ends of the first and second multiple winding parts.

The coil may additionally have a first insulating part and a second insulating part. The first insulating part is provided at the first conductor, is positioned between the winding parts of the first multiple winding part, and has higher resistance than the magnetic part. The second insulating part is provided at the second conductor, is positioned between the winding parts of the second multiple winding part, and has higher resistance than the magnetic part.

The insulating intermediate part is placed in the region over which the first multiple winding part and second multiple winding part face each other and may be constituted by non-magnetic material having a center hole, while the magnetic body may have a core provided in the center hole in the non-magnetic material.

The magnetic body may be constituted by metal magnetic material and oxide material.

The magnetic body may be constituted by a composite of metal magnetic material and synthetic resin material.

The present invention allows for thickness reduction while ensuring sufficient dielectric strength at the same time, as described above.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
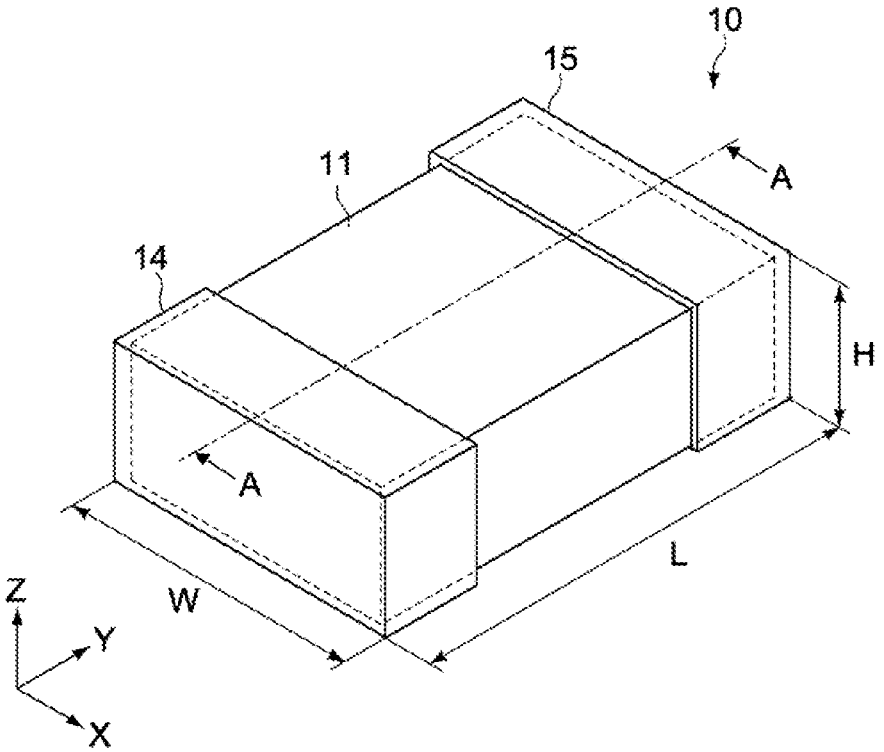
FIG. 1 is a full perspective view of the coil component pertaining to the first embodiment of the present invention.

10, 20—Coil component
12, 22—Magnetic body
13, 23—Coil
14, 15—External electrode
16, 26—Insulating intermediate part

21, 22—Insulation part
131, 132—Multiple winding part
161, 261—Non-magnetic region
162—Magnetic region

DETAILED DESCRIPTION OF EMBODIMENTS

Embodiments of the present invention are explained below by referring to the drawings.

First Embodiment

Figure 2:
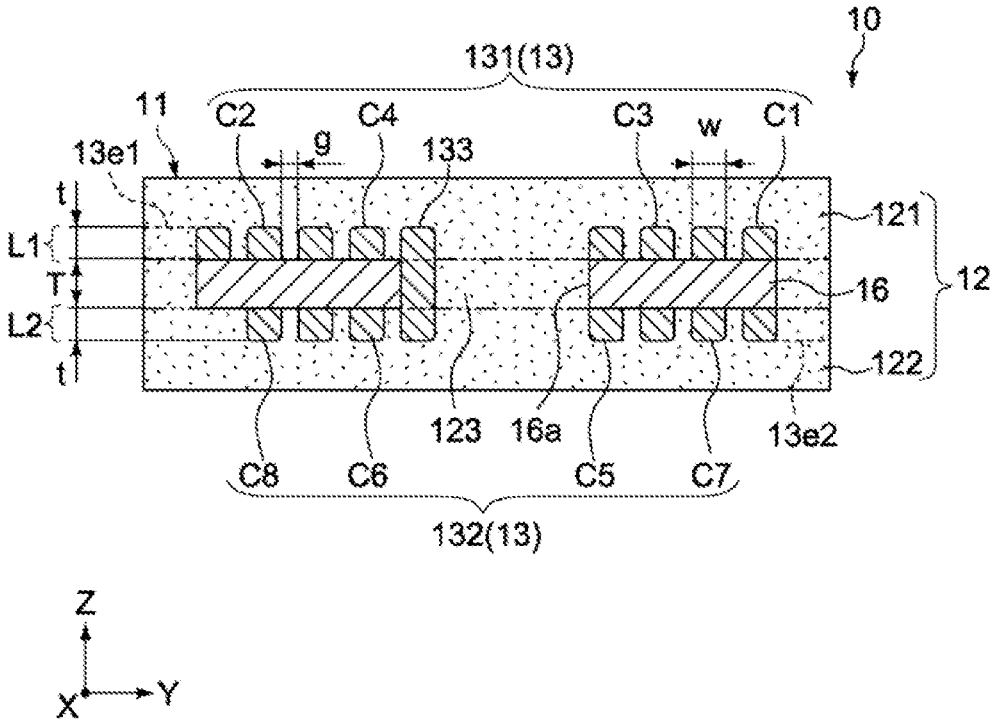
FIG. 2 is a rough section view along line A-A in FIG. 1.
Figure 3:
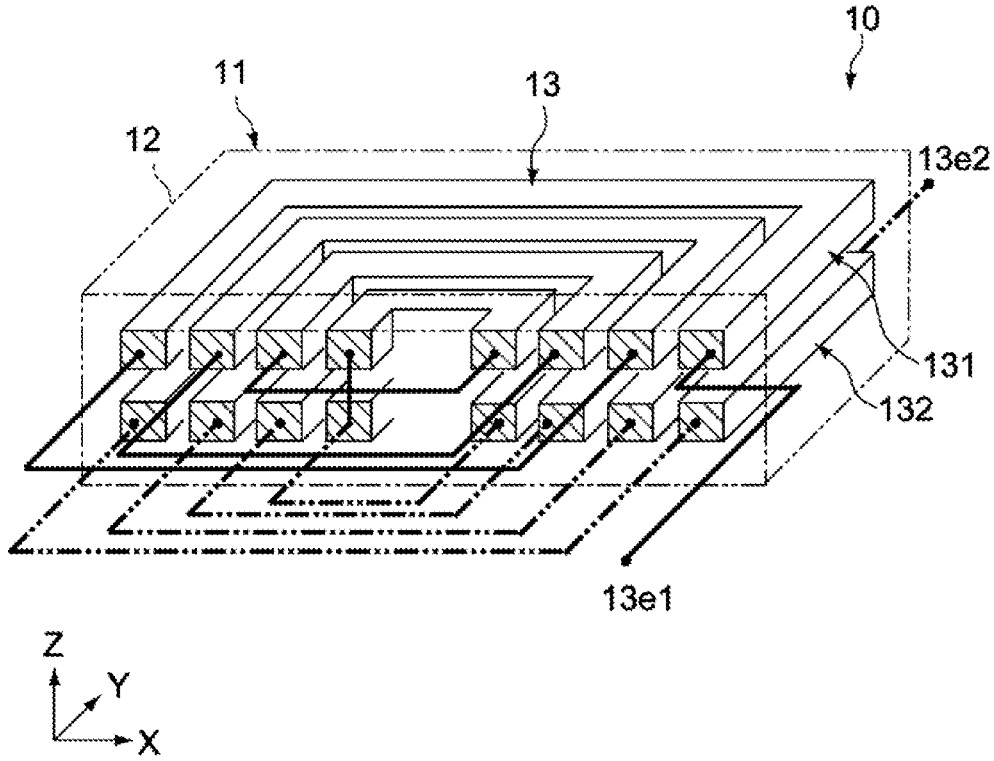
FIG. 3 is a transparent perspective section view schematically showing the coil in the coil component.

FIG. 1 is a full perspective view of the coil component pertaining to the first embodiment of the present invention. FIG. 2 is a rough section view along line A-A in FIG. 1. FIG. 3 is a transparent perspective section view schematically showing the coil inside the coil component.

A coil component 10 in this embodiment has a component body 11 and a pair of external electrodes 14, 15, as shown in FIG. 1. The component body 11 is formed as a rectangular solid shape having width W in the X-axis direction, length L in the Y-axis direction, and height H in the Z-axis direction. The pair of external electrodes 14, 15 are provided on two faces at the opposite ends of the component body 11 in the longitudinal direction (Y-axis direction).

The dimensions of the respective parts of the component body 11 are not limited in any way, and in this embodiment, its length is specified as 2 mm, width as 1.2 mm, and height as 0.7 mm.

The component body 11 has a magnetic body 12, coil 13, and insulating intermediate part 16, as shown in FIG. 2.

[Magnetic Body]

The magnetic body 12 has a first magnetic layer 121 and a second magnetic layer 122. The first and second magnetic layers 121, 122 are placed on opposite sides, in the Z-axis direction, of the coil part 13 and insulating intermediate part 16 is sandwiched between them. The first and second magnetic layers 121, 122 have the same constitution and are therefore collectively referred to as the magnetic body 12 below, except where explained separately.

The magnetic body 12 is constituted by magnetic material having soft magnetic characteristics, and oxide material. For the magnetic material, any magnetic material primarily constituted by metal magnetic grains is used. For the metal magnetic grains, FeCrSi alloy grains are adopted in this embodiment, whose composition is, for example, 1.5 to 5 percent by weight of Cr, 3 to 10 percent by weight of Si, with Fe accounting for the remainder, except for impurities, to bring the total to 100%.

For the FeCrSi alloy grains constituting the magnetic body 12, those grains whose average grain size (median size) based on volume standard is 10 μm, for example, are used. The average grain size may be in a range of 2 to 20 μm, or alternately alloy grains of different average grain sizes may be combined.

The oxide material is constituted by the oxide films formed on the surfaces of individual FeCrSi alloy grains. The oxide films are those of FeCrSi alloy grains, present as insulation films. The FeCrSi alloy grains in the magnetic body 12 are bonded together via the oxide films, and the FeCrSi alloy grains near the coil 13 are closely in contact with the coil 13 via the oxide films. The oxide films typically contain $Fe_3O_4$ belonging to the magnetic body, and at least one of $Fe_2O_3$, $Cr_2O_3$, and $SiO_2$ belonging to the non-magnetic body.

Also, the properties of the aforementioned oxide films are such that the peaks of the Si, Cr, and Fe components are found, in this order, outward from the surface of the metal magnetic grain. Other compositions besides FeCrSi include FeAlSi and FeSiTi, among others, so long as Fe is the primary component and Si, and any element other than Si that oxidizes more easily than Fe, are contained. Preferably the metal magnetic material contains Fe by 85 to 95.5 percent by weight, as well as component M other than Fe and Si and which is an element that oxidizes more easily than Fe, where the ratio of Si relative to component M, or Si/M, is greater than 1. By using such magnetic material, the above oxide films are formed stably and, in particular, high insulation property can be achieved even when heat treatment is performed at low temperature.

The magnetic permeability of the magnetic body 12 is not limited in any way and can be adjusted as deemed appropriate according to the characteristics required of the coil component 10, and in this embodiment, the magnetic permeability (μ) in room temperature is approx. 25 [H/m].

[Coil]

The coil 13 is constituted by conductive material, and has a leader end **13*e*1 that electrically connects to the external electrode 14 and a leader end 13*e*2 that electrically connects to the external electrode 15. The coil 13** is constituted by a sintered conductive paste, such as a sintered silver (Ag) paste or copper (Cu) paste.

The coil 13 is provided inside the magnetic body 12, and has a first multiple winding part 131, a second multiple winding part 132, and an inter-layer connection part 133 that inter-connects the inner periphery end of the first multiple winding part 131 and the inner periphery end of the second multiple winding part 132.

The first multiple winding part 131 constitutes a flat coil wound around the Z-axis with a first spacing.

A plurality of winding parts C1 to C4 constituting the first multiple winding part 131 each have the same width (conductor width w) and thickness (conductor thickness t), and the first spacing refers to the minimum spacing between the adjacent winding parts (inter-conductor distance g). The first multiple winding part 131 constitutes a first conductor layer L1 together with the leader end **13*e*1, and is embedded in the first magnetic layer 121. In other words, the first conductor layer L1 includes the first multiple winding part 131, leader end 13*e*1**, and first spacing.

On the other hand, the second multiple winding part 132 faces the first multiple winding part 131 in the Z-axis direction, and constitutes a flat coil wound around the Z-axis. The first multiple winding part 131 and second multiple winding part 132 are wound around the Z-axis in the same direction.

A plurality of winding parts C5 to C8 constituting the second multiple winding part 132 each have the same width (conductor width w) and thickness (conductor thickness t), and are formed with the same inter-conductor distance (g) as in the case of the first winding part 131. The second multiple winding part 132 constitutes a second conductor layer L2 together with the leader end **13*e*2, and is embedded in the second magnetic layer 122. In other words, the second conductor layer L2 includes the second multiple winding part 132, leader end 13*e*2**, and first spacing.

The first multiple winding part 131 and second multiple winding part 132 are electrically connected to each other via the inter-layer connection part 133. The number of turns N (N is a positive number of 2 or greater) of the coil 13 is determined by the number of windings of the first and second multiple winding parts 131, 132, and in this embodiment, a coil 13 with N=7.5 turns is constituted (refer to FIG. 3).

[Insulating Intermediate Part]

The insulating intermediate part 16 is provided inside the magnetic body 12 and placed between the first conductor layer L1 and second conductor layer L2.

The insulating intermediate part 16 is provided to prevent the magnetic body 12 from suffering dielectric breakdown due to the electrical potential applied between the first multiple winding part 131 and second multiple winding part 132. Typically, a potential difference corresponding to one turn generates between the conductors constituting the respective winding parts C1 to C8, while a potential difference corresponding to up to (N−1) turns generates between the winding parts C1, C8 connected to the two leader ends 13*e*1, 13*e*2.

Here, so long as the first spacing (inter-conductor distance g) is large enough to be able to ensure sufficient dielectric strength between the adjacent winding parts, the spacing that can ensure sufficient dielectric strength between the first and second multiple winding parts 131, 132 that are facing each other vertically corresponds to the product of the first spacing (inter-conductor distance g) and (N−1).

Accordingly, in this embodiment, the insulating intermediate part 16 is constituted by material whose resistance (electrical resistance) is higher than that of the magnetic body 12, and has a thickness corresponding to a second spacing (insulating intermediate thickness T) equal to or less than the product of the first spacing (inter-conductor distance g) and (N−1) (i.e., $T \leq (g \cdot (N-1))$). In some embodiments, T is equal to or greater than the minimum thickness of an insulating intermediate part which can secure uniform insulating property, e.g., the average size of particles constituting the insulating intermediate part (e.g., $0.01(g \cdot (N-1)) \leq T \leq 0.5(g \cdot (N-1))$ or the minimum thickness of resin component forming a continuous insulating film (e.g., $0.3(g \cdot (N-1)) \leq T \leq 0.8(g \cdot (N-1))$), depending on the resistivity of the material constituting the insulating intermediate part. Specifically, the insulating intermediate part 16 forms the second spacing between the first conductor layer L1 and second conductor layer L2. This way, the component body 11 can be made thinner, while ensuring sufficient dielectric strength between the multiple winding parts 131, 132 at the same time. In addition, the smaller spacing between the multiple winding parts 131, 132 means that the overall length of the coil 13 is shorter, and this in turn reduces the direct-current resistance of the coil 13.

In this embodiment, the insulating intermediate part 16 is constituted by non-magnetic material placed in the region over which the first and second multiple winding parts 131, 132 face each other. The insulating intermediate part is constituted by a frame-shaped flat film commonly supporting the winding parts C1 to C8 on the inner and outer peripheries of the first and second multiple winding parts 131, 132, and has a center hole 16*a* in the region corresponding to the wound cores of the multiple winding parts 131, 132. The center hole 16*a* has an inter-layer connection part 133 provided in it, and is also filled with a core 123 constituted as part of the magnetic body 12.

The insulating intermediate part 16 is constituted by non-magnetic material whose resistance is higher than that of the magnetic body 12. In this embodiment, such material is made from an insulating paste that contains zirconia grains, silica grains, alumina grains, or other oxide grains.

The average grain size of the oxide grains is not limited in any way, and spherical grains of 10 to 500 nm in average grain size may be used, for example. It should be noted that, the smaller the average grain size of oxide grains, the more unlikely the entry or migration of the conductive material constituting the coil 13 (multiple winding parts 131, 132) to the insulating intermediate part becomes, and consequently the smaller the inter-conductor distance (g) becomes. Also, the thickness of the non-magnetic region 161 (insulating intermediate part thickness T) can be made smaller, to support thickness reduction. Here, preferably the oxide grains are bonded together, but this is not a requirement so long as the insulation property is not affected.

On the other hand, the inner periphery side and outer periphery side of the insulating intermediate part 16 are covered with the magnetic material constituting the magnetic body 12. This increases the magnetic permeability of the magnetic field formed by the application of electric current to the multiple winding parts 131, 132, which in turn improves the inductance of the coil component 10.

The coil component 10 constituted as described above in this embodiment is produced by forming the insulating intermediate part 16 and then forming, on both sides thereof, the first and second multiple winding parts 131, 132 as well as the first and second magnetic layers 121, 122.

The method for forming each layer is not limited in any way, but typically the printing method is used. To be specific, a printing process is repeated to form the insulating intermediate part 16, first and second multiple winding parts 131, 132, and first and second magnetic layers 121, 122 (core 123). After each layer has been formed by printing, heat treatment is applied at a specified temperature to produce the component body 11. This heat treatment may be applied separately after each layer has been formed, or it may be applied to all layers at once after they have been formed. After the component body 11 has been produced, the external electrodes 14, 15 are formed by applying a paste, using the plating method, or the like.

Here, the zirconia used for the insulating intermediate part 16 do not react, but remain as independent grains, at the temperature used to heat-treat the magnetic body 12. The magnetic body 12 undergoes virtually no shrinkage even after the heat treatment. Accordingly, presence of zirconia grains does not cause defects, etc., in the magnetic body 12 after the heat treatment.

It should be noted that, if the insulating intermediate part 16 contains zirconia grains, it may also contain glass. By adding glass by 5 percent by weight or so, for example, the zirconia grains can be bonded by the glass. In addition, the strength of the component body 11 (coil component 10) can be increased, which enables further thickness reduction. What is more, the zirconia grains will not scatter even when the component is damaged. If the insulating intermediate part 16 contains glass, desirably the thickness of the insulating intermediate part 16 is 3 μm or more when shape stability and mechanical strength are considered.

Second Embodiment

Figure 4:
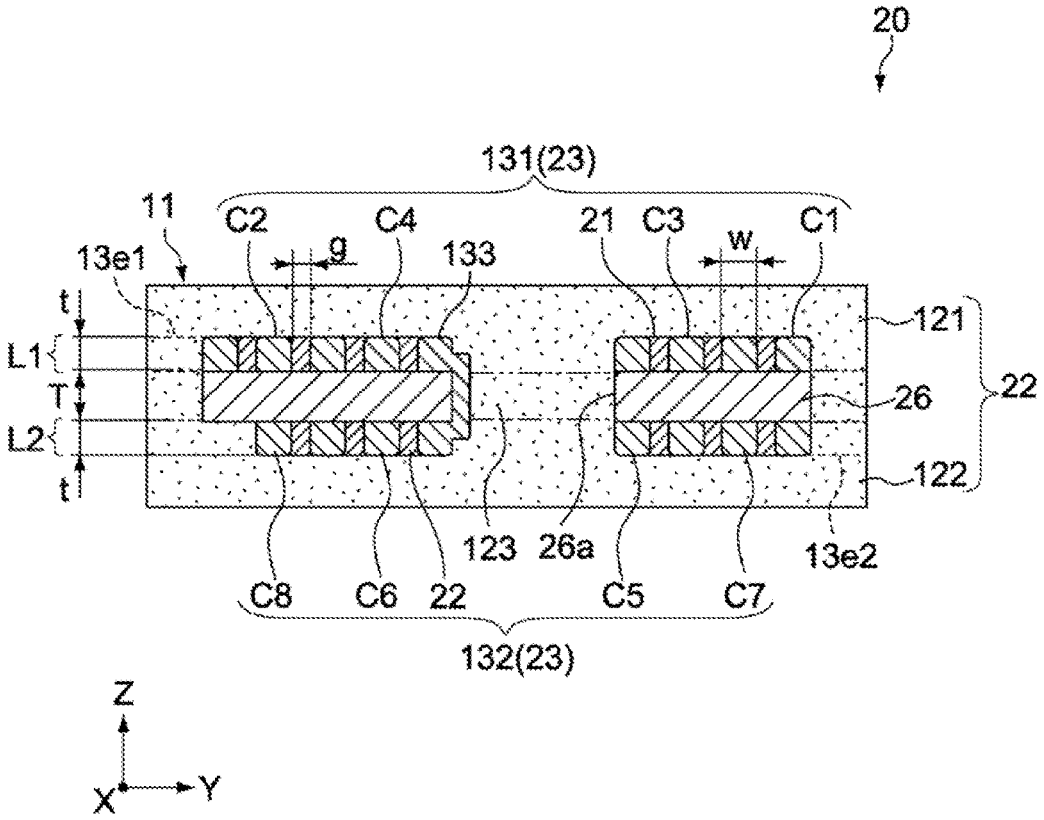
FIG. 4 is a rough section view showing the coil component pertaining to the second embodiment of the present invention.

FIG. 4 is a rough section view showing the coil component pertaining to the second embodiment of the present invention. The elements different from those in the first embodiment are primarily explained below, and the elements identical to those in the first embodiment are denoted by the same symbols and their explanation is skipped or simplified.

A coil component 20 in this embodiment is different from the aforementioned first embodiment in terms of the constitutions of a magnetic body 22, coil 23, and insulating intermediate part 26.

In this embodiment, the magnetic body 22 is constituted by a composite of metal magnetic material and synthetic resin material. For the metal magnetic material, any magnetic material explained in the aforementioned first embodiment, such as FeCrSi alloy magnetic grains, may be used. For the resin material, any resin that hardens due to heat, light, chemical reaction, etc., may be used, where examples include polyimide, epoxy resin, liquid crystal polymer, or the like. On the other hand, a top part 12 is constituted by any of the above materials, or by resin film, etc.

As in the first embodiment, the coil 23 has a first multiple winding part 131, a second multiple winding part 132, and an inter-layer connection part 133 connecting the two. The coil 23 also has a first insulation part 21 and a second insulation part 22.

The first insulation part 21 is positioned between the winding parts of the first multiple winding part 131, and constituted by material whose resistance is higher than that of the magnetic body 12. The second insulation part 22 is positioned between the winding parts of the second multiple winding part 132, and constituted by material whose resistance is higher than that of the magnetic body 12. The first and second insulation parts 21, 22 are typically constituted by resin material; for example, the material constituting the magnetic body 22, or the material constituting the resin component of the magnetic body 22, may be used.

The insulating intermediate part 26 is constituted by non-magnetic material with a center hole, which is the same as in the first embodiment; however, the material constituting the insulating intermediate part 26 is different from that in the first embodiment. In this embodiment, the insulating intermediate part 26 is constituted by a resin board whose material is not limited in any way so long as its resistance is higher than that of the magnetic body 12; here, a polyimide resin board is used. Use of a resin board for the insulating intermediate part 26 leads to thickness reduction. It should be noted that, when the ease of handling during processing, mechanical strength, etc., are considered, desirably the thickness of the insulating intermediate part 26 is 10 μm or more.

The thickness of the polyimide board constituting the insulating intermediate part 26 is formed to a size equal to or less than the product of the first spacing (inter-conductor distance g) and (N−1), as in the first embodiment. This way, an insulating intermediate part thickness (T) that can ensure sufficient dielectric strength between the first and second multiple winding parts 131, 132, can be ensured.

Also in this embodiment, operations and effects similar to those in the aforementioned first embodiment can be achieved. Particularly in this embodiment, where the coil 23 has the first and second insulation parts 21, 22, the spacing (inter-conductor distance g) between the winding parts C1 to C8 can be made narrower, and therefore the width (conductor width w) of the winding parts C1 to C8 can be increased accordingly and the resistance value can be reduced. Also, the narrower inter-conductor distance (g) allows for a smaller insulating intermediate part thickness (T), which in turn permits further thickness reduction of the coil component 20.

The coil component 20 in this embodiment can be produced using plating technology. First, the first and second multiple winding parts 131, 132 are formed according to the electroplating method, via plating resist (not illustrated), on both sides of the polyimide board which will constitute the insulating intermediate part 26. By forming a through hole beforehand in the polyimide board to form the inter-layer connection part 133, the inter-layer connection part 133 can also be formed by the electroplating method.

Next, this board is sandwiched from both sides by magnetic sheets containing alloy magnetic grains and resin, and load is applied under heating to achieve a uniform thickness all over, to bond and integrate the magnetic sheets using the resin component in the magnetic sheets. Thereafter, the sheet-integrated board is cut into individual pieces, and to provide each multiple winding part with electrical continuity, a conductive film is sputtered or conductive paste is applied over the areas where the external terminals are to be formed, after which the film/paste is hardened, and then plating is applied at the end.

The insulation parts 21, 22 positioned between the winding parts can be formed before or after the winding parts are formed. If they are formed before the winding parts, the plating resist for forming the winding parts can be used directly as the insulation parts 21, 22. If formed after the winding parts, they can be formed by pouring in resin.

The resistivity values of the magnetic body 12, insulating intermediate part 26, and insulation parts 21, 22 are not limited in any way; for example, the magnetic body 12 may have a resistivity of $10^6$ Ω·cm or more, and the insulating intermediate part 26 and insulation parts 21, 22 may have a resistivity of $10^8$ Ω·cm or more.

EXAMPLES

The examples conducted by the inventors of the present invention are explained below.

Example 1

A sample coil component pertaining to the first embodiment (refer to FIG. 2) was produced, comprising: a coil 13 having 7.5 turns, conductor width w of 15 μm, conductor thickness t of 15 μm, and inter-conductor distance g of 20 μm, and multiple winding parts 131, 132 constituted by an Ag paste; and an insulating intermediate part 16 having insulating intermediate part thickness T of 30 μm and constituted by a sintered compact of zirconia grains (average grain size: 5 μm).

Example 2

A sample coil component was produced according to the same constitution as in Example 1, except that the average grain size of zirconia grains was adjusted to 1 μm and the insulating intermediate part thickness T was adjusted to 5 μm.

Example 3

A sample coil component was produced according to the same constitution as in Example 1, except that the average grain size of zirconia grains was adjusted to 0.1 μm and the insulating intermediate part thickness T was adjusted to 3 μm.

Example 4

A sample coil component was produced according to the same constitution as in Example 1, except that the insulating intermediate part 16 used silica grains (average grain size: 0.1 μm) and the insulating intermediate part thickness T was adjusted to 3 μm.

Example 5

A sample coil component pertaining to the second embodiment (refer to FIG. 4) was produced, comprising: a coil 23 having 7.5 turns, conductor width w of 15 μm, conductor thickness t of 15 μm, inter-conductor distance g of 20 μm, and multiple winding parts 131, 132 constituted by Cu paste; an insulating intermediate part 26 having insulating intermediate part thickness T of 55 μm and constituted by a polyimide board; and insulation parts 21, 22 constituted by the same material as the magnetic body 12.

Example 6

A sample coil component was produced according to the same constitution as in Example 5, except that the conductor width w was adjusted to 23 μm, inter-conductor distance g was adjusted to 9 μm, insulating intermediate part thickness T was adjusted to 30 μm, and the insulation parts 21, 22 were constituted by the resin component (epoxy resin) constituting the magnetic body 22.

Example 7

A sample coil component was produced according to the same constitution as in Example 5, except that the conductor width w was adjusted to 26 μm, conductor thickness t was adjusted to 20 μm, inter-conductor distance g was adjusted to 5 μm, insulating intermediate part thickness T was adjusted to 25 μm, and the insulation parts 21, 22 were constituted by the resin component (epoxy resin) constituting the magnetic body 22.

Comparative Example 1

A sample coil component was produced according to the same constitution as in Example 1, except that the insulating intermediate part thickness T was adjusted to 160 μm and the insulating intermediate part was constituted by the same material used for the magnetic body 22.

The constitutional conditions of Examples 1 to 7 and Comparative Example 1 above are shown in Tables 1 and 2.

TABLE 1

| | Magnetic body | Winding part/ electrode material | Insulating intermediate part Grain size μm | | Insulation part | Number of windings N |
|---|---|---|---|---|---|---|
| Comparative Example 1 | Heat treatment | Ag | Alloy magnetic grains | — | — | 7.5 |
| Example 1 | Heat treatment | Ag | zirconia grains | 5 | — | 7.5 |
| Example 2 | Heat treatment | Ag | zirconia grains | 1 | — | 7.5 |
| Example 3 | Heat treatment | Ag | zirconia grains | 0.1 | — | 7.5 |
| Example 4 | Heat treatment | Ag | Silica grains | 0.1 | — | 7.5 |
| Example 5 | Resin | Cu | Resin board | — | — | 7.5 |
| Example 6 | Resin | Cu | Resin board | — | Resin | 7.5 |
| Example 7 | Resin | Cu | Resin board | — | Resin | 7.5 |

TABLE 2

| | Conductor width W [μm] | Conductor thickness T [μm] | Inter-conductor distance X [μm] | Insulating intermediate part thickness T [μm] | T/N [μm] |
|---|---|---|---|---|---|
| Comparative Example 1 | 15 | 15 | 20 | 160 | 24.6 |
| Example 1 | 15 | 15 | 20 | 30 | 4.6 |
| Example 2 | 15 | 15 | 20 | 5 | 0.8 |
| Example 3 | 15 | 15 | 20 | 3 | 0.5 |
| Example 4 | 15 | 15 | 20 | 3 | 0.5 |
| Example 5 | 15 | 15 | 20 | 55 | 8.5 |
| Example 6 | 23 | 15 | 9 | 30 | 4.6 |
| Example 7 | 26 | 20 | 5 | 25 | 3.8 |

The samples in Examples 1 to 7 and Comparative Example 1 were evaluated for inductance, direct-current resistance, and withstand voltage under the same conditions. The results are shown in Table 3.

TABLE 3

| | Inductance [%] | Direct-current resistance [%] | Withstand voltage |
|---|---|---|---|
| Comparative Example 1 | — | — | Proor |
| Example 1 | 8 | −1 | Good |
| Example 2 | 16 | −3 | Good |
| Example 3 | 17 | −3 | Good |
| Example 4 | 17 | −3 | Good |
| Example 5 | 7 | −1 | Good |
| Example 6 | 8 | −8 | Good |
| Example 7 | 10 | −10 | Good |

As for inductance and direct-current resistance, changes from the inductance value and direct-current value of the sample pertaining to Comparative Example 1 were evaluated in percent figures. The samples pertaining to Examples 1 to 7 all had higher inductance, and lower direct-current resistance, than the sample pertaining to Comparative Example 1. Also, the withstand voltage condition that was poor in Comparative Example 1, was good in all of Examples 1 to 7.

As shown above, Examples 1 to 7, where the insulating intermediate part thickness T was equal to or less than the product of the inter-conductor distance g and (N (number of turns)−1), exhibited good withstand voltage relative to Comparative Example 1 where T was greater than the aforementioned product.

Also, all of the samples (Examples 2 to 4) whose T/N (the insulating intermediate part thickness T divided by the number of turns) was smaller exhibited improved inductance characteristics and direct-current resistance characteristics.

The foregoing explained embodiments of the present invention; however, it goes without saying that the present invention is not limited to the aforementioned embodiments and that various changes can be added.

For example, the aforementioned embodiments were explained using a coil component with 7.5 turns as an example; however, the number of turns is not limited thereto and any number of turns can be set as deemed appropriate according to the required specifications and characteristics.

Also, in the aforementioned first embodiment, an example of constituting the non-magnetic region 161 of the insulating intermediate part 16 with a sintered compact of zirconia grains or silica grains was explained; however, this non-magnetic region 161 can also be constituted by a resin board, just like in the second embodiment.

Similarly, the insulation parts 21, 22 explained in the second embodiment may be applied to the coil component explained in the first embodiment.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-073079, filed Mar. 31, 2016, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

a magnetic body of rectangular solid shape, constituted by a metal magnetic material with an oxide material or synthetic resin material;

a coil with N turns, where N is a positive number of 2 or greater, provided inside the magnetic body, which has: a first conductor layer having a first multiple winding part which is wound around one axis with a first spacing in μm denoted by "g"; a second conductor layer having a second multiple winding part which is wound around the one axis with the first spacing and faces the first conductor layer; and an inter-layer connection part that inter-connects an inner periphery end of the first multiple winding part and an inner periphery end of the second multiple winding part;

an insulating intermediate part which is provided inside the magnetic body and forms, between the first conductor layer and second conductor layer, wherein a second spacing in μm denoted by "T" corresponding to a thickness of the insulating intermediate part satisfies $T \leq 0.8(g \cdot (N-1))$, said insulating intermediate part having an electrical resistance higher than that of the magnetic body and having a thickness of 30 μm or less, wherein a resistivity of the insulating intermediate part is $10^8$ Ω·cm or more, and a resistivity of the magnetic body is $10^6$ Ω·cm or more, wherein the insulating intermediate part is constituted by spherical oxide grains of 10 to 500 nm in average grain size; and external electrodes provided on the magnetic body and connected, respectively, to outer periphery ends of the first and second multiple winding parts.

2. A coil component according to claim 1, wherein the coil further has:

a first insulation part which is provided on the first conductor, positioned between winding parts of the first multiple winding part, and has higher resistance than the magnetic part; and a second insulation part which is provided on the second conductor, positioned between winding parts of the second multiple winding part, and which has higher resistance than the magnetic part.

3. A coil component according to claim 1, wherein the insulating intermediate part is placed in a region over which the first multiple winding part and second multiple winding part face each other and is constituted by non-magnetic material having a center hole, and the magnetic body has a core provided in the center hole in the non-magnetic material.

4. A coil component according to claim 2, wherein the insulating intermediate part is placed in a region over which the first multiple winding part and second multiple winding part face each other and is constituted by non-magnetic material having a center hole, and the magnetic body has a core provided in the center hole in the non-magnetic material.

5. A coil component according to claim 1, wherein the insulating intermediate part is constituted by a non-magnetic material.

6. A coil component according to claim 1, wherein the insulating intermediate part is constituted by zirconia grains and glass.

7. A coil component according to claim 1, wherein the insulating intermediate part has a thickness of 3 μm or more but 30 μm or less.

8. A coil component according to claim 1, wherein the first spacing (g) is 5 μm to 20 μm.

* * * * *